US007938232B2

(12) United States Patent
Hikita et al.

(10) Patent No.: US 7,938,232 B2
(45) Date of Patent: May 10, 2011

(54) EVACUATION CONTROL APPARATUS FOR AN ELEVATOR

(75) Inventors: Shiro Hikita, Tokyo (JP); Kiyoji Kawai, Tokyo (JP)

(73) Assignee: Mitsubishi Electric Corporation, Tokyo (JP)

( * ) Notice: Subject to any disclaimer, the term of this patent is extended or adjusted under 35 U.S.C. 154(b) by 793 days.

(21) Appl. No.: 11/993,226

(22) PCT Filed: Jan. 19, 2006

(86) PCT No.: PCT/JP2006/300713

§ 371 (c)(1),
(2), (4) Date: Dec. 20, 2007

(87) PCT Pub. No.: WO2007/083374

PCT Pub. Date: Jul. 26, 2007

(65) Prior Publication Data

US 2010/0224451 A1 Sep. 9, 2010

(51) Int. Cl.
*B66B 1/20* (2006.01)

(52) U.S. Cl. ..... 187/384; 187/387; 187/313

(58) Field of Classification Search ..... 187/247, 187/248, 313, 316, 317, 290, 293, 380–389, 187/391–393

See application file for complete search history.

(56) References Cited

U.S. PATENT DOCUMENTS 5,979,607 A * 11/1999 Allen ..... 187/390
6,000,505 A * 12/1999 Allen ..... 187/391
7,182,174 B2 * 2/2007 Parrini et al. ..... 182/18
7,210,564 B2 * 5/2007 Kawai ..... 187/384
7,461,723 B2 * 12/2008 Kawai ..... 187/313
7,588,126 B2 * 9/2009 Siikonen et al. ..... 187/384
7,621,378 B2 * 11/2009 Kawai ..... 187/313
7,637,354 B2 * 12/2009 Kawai ..... 187/313
7,669,695 B2 * 3/2010 Hikita et al. ..... 187/284
2009/0038892 A1 * 2/2009 Kawai et al. ..... 187/387

(Continued)

FOREIGN PATENT DOCUMENTS

JP 5 8954 1/1993

(Continued)

OTHER PUBLICATIONS

Al Sekizawa, et al., "Study on Feasibility of Evacuation using Elevators in a High-rise Building (Part. 2)", Examination from the viewpoint of transportation efficiency, pp. 590-593, 2004. (with partial english translation).

*Primary Examiner* — Jonathan Salata
(74) *Attorney, Agent, or Firm* — Oblon, Spivak, McClelland, Maier & Neustadt, L.L.P.

(57) ABSTRACT

An evacuation control apparatus for an elevator controls, in an event of a fire in a building provided with an elevator that is assigned to a plurality of floors as service floors, an operation of the elevator. The evacuation control apparatus for the elevator has an evacuation operation performing portion, a determination portion, and an evacuation operation resuming portion. The evacuation operation performing portion sets at least one of the service floors as a rescue floor, and performs evacuation operation for the elevator to convey those stranded in the building from the rescue floor to an evacuation floor. When a predetermined termination condition is fulfilled during evacuation operation, the determination portion determines that evacuation operation should be terminated. When a predetermined resumption condition is fulfilled after evacuation operation is terminated due to a determination made by the determination portion, the evacuation operation resuming portion determines that evacuation operation should be resumed.

4 Claims, 2 Drawing Sheets

U.S. PATENT DOCUMENTS

| | | | | |
|---|---|---|---|---|
| 2009/0127030 | A1* | 5/2009 | Hikita et al. | 187/387 |
| 2009/0321190 | A1* | 12/2009 | Kawai et al. | 187/247 |
| 2010/0213011 | A1* | 8/2010 | Hikita et al. | 187/247 |
| 2010/0236868 | A1* | 9/2010 | Hikita | 187/247 |

FOREIGN PATENT DOCUMENTS

| | | |
|---|---|---|
| JP | 2002 509850 | 4/2002 |
| JP | 2005-187162 | 7/2005 |
| WO | 99/50165 | 10/1999 |

* cited by examiner

EVACUATION CONTROL APPARATUS FOR AN ELEVATOR

TECHNICAL FIELD

The present invention relates to an evacuation control apparatus for an elevator which serves to evacuate those stranded in a building when a fire occurs in the building.

BACKGROUND ART

Conventionally, there is proposed a system of operating elevators which is designed to perform control operation individually for each of a plurality of elevator groups to stop cars at nearest floors when a fire occurs in a building in which the plurality of elevator groups are installed. An order of priority for starting control operation is set for each of the elevator groups based on a fire occurrence floor. This control operation is started for the elevator groups in the order of priorities. Thus, the duration of normal operation of those of the elevator groups which are not significantly influenced by the fire can be extended (see Patent Document 1).

Patent Document 1: JP 05-8954 A

DISCLOSURE OF THE INVENTION

Problem to be Solved by the Invention

In recent buildings, technologies such as fire-preventing separation have been improved. However, in the system of operating the elevators disclosed in Patent Document 1, the duration of normal operation of only one or some of the elevator groups can be slightly extended. After the cars have been stopped through control operation, those in the building cannot be conveyed to an evacuation floor although the cars are allowed to be moved in some cases. Accordingly, the efficiency in conveying those stranded in the building in the event of a fire cannot be enhanced.

The present invention has been made to solve the above-mentioned problem, and it is therefore an object of the present invention to provide an evacuation control apparatus for an elevator which makes it possible to enhance the efficiency in conveying those stranded in a building in the event of a fire to an evacuation floor.

Means for Solving the Problem

An evacuation control apparatus for an elevator according to the present invention controls, in an event of a fire in a building provided with an elevator that is assigned to a plurality of floors as service floors, an operation of the elevator. The evacuation control apparatus includes: an evacuation operation performing portion for setting at least one of the service floors as a rescue floor and performing evacuation operation for the elevator to convey those stranded in the building from the rescue floor to an evacuation floor; a determination portion for determining that the evacuation operation should be terminated, when a predetermined termination condition is fulfilled during the evacuation operation; and an evacuation operation resuming portion for determining that the evacuation operation should be resumed, when a predetermined resumption condition is fulfilled after the evacuation operation is terminated due to a determination made by the determination portion.

BEST MODE FOR CARRYING OUT THE INVENTION

A preferred embodiment of the present invention will be described hereinafter with reference to the drawings.

Embodiment 1

Figure 1:
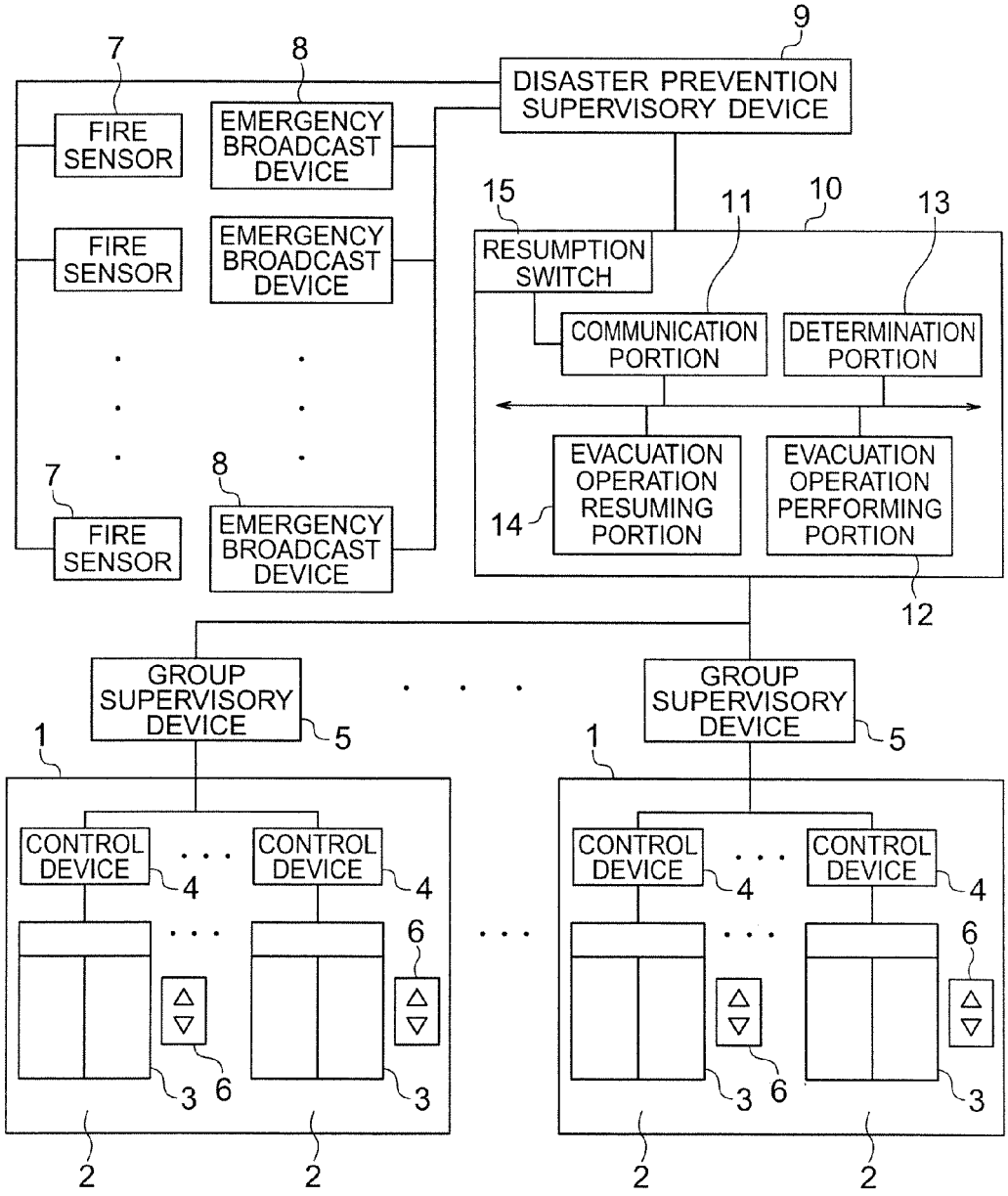
FIG. 1 is a block diagram showing an evacuation control apparatus for an elevator according to Embodiment 1 of the present invention.

FIG. 1 is a block diagram showing an evacuation control apparatus for an elevator according to Embodiment 1 of the present invention. Referring to FIG. 1, a plurality of elevator groups 1 are provided in a building (not shown). Each of the elevator groups 1 has a plurality of elevators 2 that are assigned to a plurality of floors as service floors. Each of the elevators 2 has a car 3 and a control device 4. The cars 3 can be stopped at the service floors and an evacuation floor. The control devices 4 control the movements of the cars 3. In this example, the evacuation floor is a hallway floor where a hallway of the building is provided.

Each of the elevator groups 1 is provided with a group supervisory device 5. Each of the group supervisory devices 5 serves to control the operations of corresponding ones of the elevators 2 comprehensively. Landing call buttons 6 for registering landing calls are provided for the elevators 2 at each of the service floors and the evacuation floor. When a landing call is registered through the manipulation of one of the landing call buttons 6, that one of the cars 3 in a corresponding one of the elevator groups 1 which should respond to the landing call is allocated by a corresponding one of the group supervisory devices 5.

Each of the floors of the buildings is provided with a fire sensor 7 for sensing the occurrence of a fire, and an emergency broadcast device 8 for delivering a broadcast to the entire building to provide guidance in evacuation in an emergency. Information from the fire sensors 7 is transmitted to a disaster prevention supervisory device 9 for controlling disaster prevention components in the entire building comprehensively. The disaster prevention supervisory device 9 detects whether or not a fire has occurred and identifies a fire occurrence floor, based on the information from the fire sensors 7.

Information from the disaster prevention supervisory device 9 is transmitted to an evacuation control apparatus 10 for controlling the group supervisory devices 5 comprehensively in the event of a fire. After the occurrence of the fire has been detected by the disaster prevention supervisory device 9, the evacuation control apparatus 10 performs evacuation operation for each of the elevator groups 1 to convey those stranded in the building to the evacuation floor. The disaster prevention supervisory device 9 and the evacuation control apparatus 10 are provided in a supervisory room (disaster prevention center) for monitoring and controlling the facilities and components related to disaster prevention in a concentrated manner.

The evacuation control apparatus 10 has a communication portion 11, an evacuation operation performing portion 12, a determination portion 13, and an evacuation operation resuming portion 14.

The communication portion 11 allows each of the group supervisory devices 5 and the disaster prevention supervisory device 9 to exchange information with the evacuation control apparatus 10.

The evacuation operation performing portion 12 outputs a command to perform evacuation operation to each of the group supervisory devices 5, thereby performing evacuation operation for each of the elevators 2. Evacuation operation is performed by setting at least one of the service floors as a rescue floor and moving each of the cars 3 between the rescue floor and the evacuation floor. When one of the landing call buttons 6 is manipulated at the landing of the rescue floor during evacuation operation, that one of the cars 3 which should respond to a landing call is controlled by a corresponding one of the control devices 4 to be moved to the rescue floor. The car 3 that has reached the rescue floor is moved to the evacuation floor after those in the building get thereon.

In this example, the evacuation operation performing portion 12 sets all the service floors as rescue floors. Thus, each of the cars 3 can land at all the service floors and the evacuation floor during evacuation operation. That is, evacuation operation of each of the elevators 2 is the same as normal operation performed through the control in a normal state.

The determination portion 13 determines whether or not evacuation operation can be performed for each of the elevator groups 1, based on information from the disaster prevention supervisory device 9 and information from the evacuation operation performing portion 12. That is, the determination portion 13 determines whether or not evacuation operation can be performed for each of the elevator groups 1, based on a positional relationship between the rescue floors and the fire occurrence floor.

The determination portion 13 determines whether or not evacuation operation can be terminated for each of the elevator groups 1, based on information from the elevator groups 1. That is, the determination portion 13 determines that evacuation operation should be terminated (makes an affirmative determination on the termination of operation) when a predetermined termination condition, which is obtained based on the information from each of the elevator groups 1, is fulfilled during evacuation operation, and determines that evacuation operation should be continued (makes an affirmative determination on the continuation of operation) when the predetermined termination condition is not fulfilled during evacuation operation. Evacuation operation of each of the elevator groups 1 is terminated when the determination portion 13 determines that evacuation operation should be terminated, and is continued when the determination portion 13 determines that evacuation operation should be continued.

The predetermined termination condition is fulfilled, for example, when a boarding detecting sensor (e.g., a weighing device) for detecting the presence of people getting on each of the elevators 2 remains stopped detecting the presence of people getting on, the occurrence of a landing call through the manipulation of any one of the landing call buttons 6 remains absent at all the rescue floors for a predetermined time, a termination button installed in each of the elevator groups 1 is manipulated, or when an abnormality detecting sensor installed in each of the elevator groups 1 is actuated due to the spread of a fire, the inundation resulting from fire fighting, or the like. That is, the predetermined termination condition is fulfilled when the continuation of evacuation operation becomes difficult or when a condition for completing evacuation operation is fulfilled.

It should be noted herein that the evacuation control apparatus 10 is provided with a resumption switch (manual switch) 15 for resuming terminated evacuation operation. The resumption switch 15 can be manually manipulated in the supervisory room. Information from the resumption switch 15 is transmitted to the evacuation operation resuming portion 14 via the communication portion 11.

After evacuation operation is terminated due to an affirmative determination made by the determination portion 13 on the termination of operation, the evacuation operation resuming portion 14 determines as to each of the elevator groups 1 whether or not evacuation operation can be resumed, based on information from the elevator groups 1, information from the determination portion 13, and information from the resumption switch 15. That is, after the termination of evacuation operation, the evacuation operation resuming portion 14 determines that evacuation operation should be resumed (makes an affirmative determination on the resumption of operation) when a predetermined resumption condition, which is obtained based on the information from the elevator groups 1, the information from the determination portion 13, and the information from the resumption switch 15, is fulfilled, and determines that evacuation operation should remain terminated (makes an affirmative determination on the continuation of termination) when the predetermined resumption condition is not fulfilled. Evacuation operation of each of the elevator groups 1 is resumed when the evacuation operation resuming portion 14 makes an affirmative determination on the resumption of operation, and remains terminated when the evacuation operation resuming portion 14 makes an affirmative determination on the continuation of termination.

The predetermined resumption condition is fulfilled, for example, when the boarding detecting sensor detects the presence of people getting on or a landing call occurs through the manipulation of one of the landing call buttons 6 at one of the rescue floors while evacuation operation can be performed, or when the resumption switch 15 is manipulated while evacuation operation can be performed. That is, the predetermined resumption condition is fulfilled when the presence of people in the building is detected while evacuation operation can be performed.

The evacuation control apparatus 10 is constituted by a computer having a calculation processing portion (CPU), a storage portion (ROM, RAM, or the like), and signal input/output portions. The functions of the communication portion 11, the evacuation operation performing portion 12, the determination portion 13, and the evacuation operation resuming portion 14 are realized by the computer constituting the evacuation control apparatus 10.

That is, programs for realizing the functions of the communication portion 11, the evacuation operation performing portion 12, the determination portion 13, and the evacuation operation resuming portion 14 are stored in the storage portion of the computer. Information on the rescue floors is also stored in the storage portion. The calculation processing portion performs a calculation processing regarding the function of the evacuation control apparatus 10 based on the programs stored in the storage portion.

Figure 2:
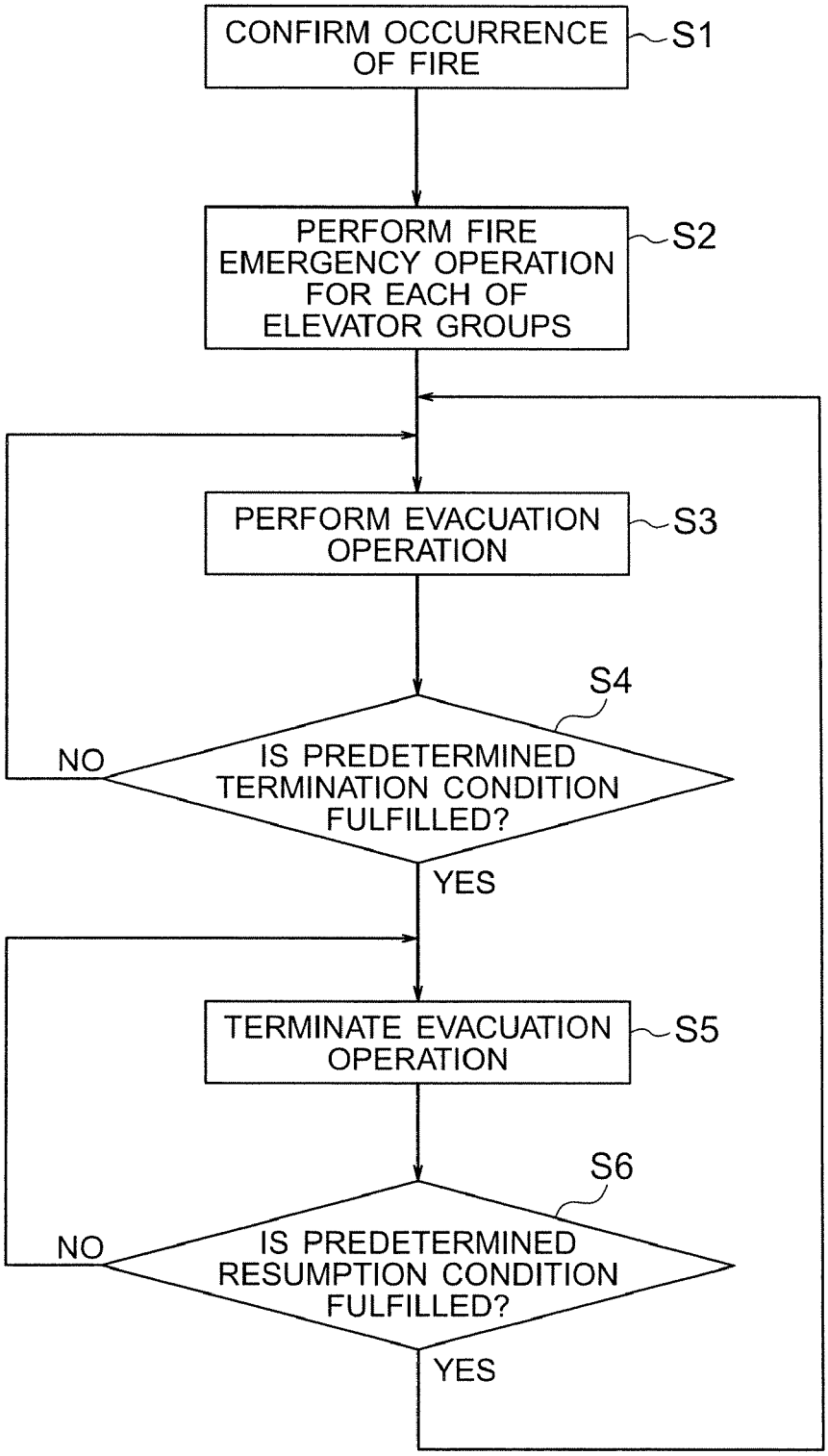
FIG. 2 is a flowchart for explaining the processing operation of the evacuation control apparatus for the elevator shown in FIG. 1.

Next, an operation will be described. FIG. 2 is a flowchart for explaining the processing operation of the evacuation control apparatus for the elevator shown in FIG. 1. As shown in FIG. 2, when the occurrence of a fire is confirmed by the disaster prevention supervisory device 9 (S1), information confirming the occurrence of the fire is transmitted from the disaster prevention supervisory device 9 to the evacuation control apparatus 10. After that, a command to perform control operation is output from the evacuation control apparatus 10 to each of the group supervisory devices 5, so fire emergency operation of a corresponding one of the elevator groups 1 is performed. In fire emergency operation, each of the moving cars 3 is stopped at a nearest floor and caused to wait in a door-open state (S2).

After that, the evacuation operation performing portion 12 sets the rescue floors, and evacuation operation is performed for each of the elevator groups 1 (S3). After that, the determination portion 13 determines whether or not the predetermined termination condition is fulfilled. That is, the determination portion 13 determines whether or not the continuation of evacuation operation has become difficult and whether or not the condition for completing evacuation operation has been fulfilled (S4).

When it is determined that the predetermined termination condition is not fulfilled, the determination portion 13 makes an affirmative determination on the continuation of operation, so evacuation operation is continued. When it is determined that the predetermined termination condition is fulfilled, the determination portion 13 makes an affirmative determination on the termination of operation, so evacuation operation is terminated (S5).

After that, the evacuation operation resuming portion 14 determines whether or not the predetermined resumption condition is fulfilled. That is, the evacuation operation resuming portion 14 determines whether or not the presence of at least one person in the building has been detected while evacuation operation can be performed (S6).

When it is determined that the predetermined resumption condition is fulfilled, the evacuation operation resuming portion 14 makes an affirmative determination on the resumption of operation, so evacuation operation is resumed. When it is determined that the predetermined resumption condition is not fulfilled, evacuation operation remains terminated.

In the evacuation control apparatus for the elevator configured as described above, evacuation operation is resumed when the predetermined resumption condition is fulfilled after the termination of evacuation operation. Therefore, even when there are people in the building after the termination of evacuation operation, those in the building can be conveyed from the rescue floors to the evacuation floor through resumed evacuation operation. Thus, the efficiency in conveying those in the building to the evacuation floor can be enhanced.

The predetermined termination condition is fulfilled when at least one of detection of the presence of people getting on the elevators 2 and the occurrence of landing calls at all the rescue floors remains stopped for a predetermined time. Therefore, the performance of unnecessary evacuation operation can be avoided after those in the building have been evacuated. As a result, the occurrence of inconveniences resulting from the continuation of evacuation operation (e.g., unnecessary consumption of electric power and malfunctions in the elevators 2) can be prevented.

The predetermined resumption condition is fulfilled when at least one of detection of the presence of people getting on the elevators 2 and the occurrence of a landing call at one of the rescue floors is confirmed while evacuation operation can be performed. Therefore, even when, for example, those in the building have trouble moving and then reach the landings at the rescue floors after evacuation operation has already been terminated, they can resume evacuation operation on the spot. Accordingly, the efficiency in conveying those in the building to the evacuation floor can further be enhanced.

The resumption switch 15, which can be manually manipulated, is provided in the supervisory room of the building, and the predetermined resumption condition is fulfilled when the resumption switch 15 is manipulated while evacuation operation can be performed. Therefore, a supervisor in the supervisory room can manipulate the resumption switch 15 to resume evacuation operation that has already been terminated. In the case where, for example, cameras (photographing devices) are installed at the landings of the rescue floors and monitors for displaying images photographed by the cameras are installed in the supervisory room, the images of those in the building may be displayed on the monitors after the termination of evacuation operation. Also, firefighters may discover those in the building and contact the supervisor in the supervisory room. In such a case, evacuation operation can be resumed through the manipulation in the supervisory room to convey those in the building to the evacuation floor. Therefore, the efficiency in conveying those in the building to the evacuation floor can further be enhanced.

In the foregoing example, evacuation operation of each of the elevators 2 is performed in the same manner as normal operation while all the service floors are set as the rescue floors. However, it is also appropriate to set predetermined ones of the service floors as rescue floors in advance, and perform evacuation operation by vertically reciprocating each of the cars 3 between the rescue floors and the evacuation floor. In this case, during evacuation operation, each of the cars 3 is stopped only at the rescue floors and the evacuation floor and move past all the floors located between the rescue floors and the evacuation floor. Those who are at a floor other than the rescue floors in the building move to a suitable one of the rescue floors by, airs provided in the building, in order to use a suitable one of the elevators 2. In this manner, the number of floors at which the cars 3 are stopped can be reduced, so the efficiency in conveying those in the building to the evacuation floor can further be enhanced.

The system of performing evacuation operation is not limited to the foregoing method but may be set in advance according to, for example, the shape of the building, the intended purpose of the building, or the number of people accommodated in the building.

The invention claimed is:

1. An evacuation control apparatus for an elevator which controls, in an event of a fire in a building provided with an elevator that is assigned to a plurality of floors as service floors, an operation of the elevator, the evacuation control apparatus comprising:

an evacuation operation performing portion for setting at least one of the service floors as a rescue floor and performing evacuation operation for the elevator to convey those stranded in the building from the rescue floor to an evacuation floor;

a determination portion for determining that the evacuation operation should be terminated, when a predetermined termination condition is fulfilled during the evacuation operation; and an evacuation operation resuming portion for determining that the evacuation operation should be resumed, when a predetermined resumption condition is fulfilled after the evacuation operation is terminated due to a determination made by the determination portion.

2. An evacuation control apparatus for an elevator according to claim 1, wherein the predetermined termination condition is fulfilled when at least one of detection of presence of people getting on the elevator and occurrence of a landing call at the rescue floor remains stopped for a predetermined time.

3. An evacuation control apparatus for an elevator according to claim 1, wherein the predetermined resumption condition is fulfilled when at least one of detection of presence of people getting on the elevator and occurrence of a landing call at the rescue floor is confirmed while the evacuation operation can be performed.

4. An evacuation control apparatus for an elevator according to claim 1, wherein the building has a supervisory room provided with a manual switch that can be manipulated manually, and the predetermined resumption condition is fulfilled when the manual switch is manipulated while the evacuation operation can be performed.

* * * * *